US006796039B2

(12) United States Patent
Walbrink

(10) Patent No.: US 6,796,039 B2
(45) Date of Patent: Sep. 28, 2004

(54) ARCHERY SIGHT

(75) Inventor: Kirt L. Walbrink, 6800 Cooley Rd., Fruitport, MI (US) 49415

(73) Assignee: Kirt L. Walbrink, Fruitport, MI (US)

( * ) Notice: Subject to any disclaimer, the term of this patent is extended or adjusted under 35 U.S.C. 154(b) by 0 days.

(21) Appl. No.: 10/348,710

(22) Filed: Jan. 22, 2003

(65) Prior Publication Data

US 2003/0136012 A1 Jul. 24, 2003

Related U.S. Application Data

(60) Provisional application No. 60/351,059, filed on Jan. 23, 2002.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | | |
|---|---|---|---|---|---|
| 3,163,697 | A | | 12/1964 | White | |
| 3,666,368 | A | | 5/1972 | Sprandel | |
| 3,674,002 | A | | 7/1972 | Diamond, Sr. | |
| 4,178,693 | A | | 12/1979 | Smith | |
| 4,418,479 | A | | 12/1983 | Stachnik | |
| 4,497,116 | A | | 2/1985 | Hawkins | |
| 4,979,309 | A | | 12/1990 | Oligschlaeger | |
| 4,995,166 | A | | 2/1991 | Knemeyer | |
| 5,001,837 | A | | 3/1991 | Bray | |
| 5,359,780 | A | | 11/1994 | Dallaire | |
| 5,367,780 | A | * | 11/1994 | Savage | 33/265 |
| 5,398,420 | A | * | 3/1995 | Kleinschmidt | 33/265 |
| 5,425,177 | A | * | 6/1995 | Pacenti | 33/265 |
| 5,442,862 | A | | 8/1995 | Newbold et al. | |
| 5,454,169 | A | * | 10/1995 | Keller | 33/265 |
| 5,465,491 | A | * | 11/1995 | Thell | 33/265 |
| 5,511,317 | A | | 4/1996 | Allen | |
| 5,579,752 | A | | 12/1996 | Nelson et al. | |
| 5,632,091 | A | * | 5/1997 | Brion et al. | 33/265 |
| 5,651,185 | A | | 7/1997 | Vanderheyden et al. | |
| 5,671,724 | A | * | 9/1997 | Priebe | 124/87 |
| 5,718,215 | A | | 2/1998 | Kenny et al. | |
| 5,802,726 | A | * | 9/1998 | Trosper et al. | 33/265 |
| 5,864,958 | A | * | 2/1999 | Giddens | 33/265 |
| 5,920,996 | A | | 7/1999 | Hurckman et al. | |
| RE36,266 | E | | 8/1999 | Gibbs | |
| 5,941,226 | A | | 8/1999 | Marietta | |
| 6,061,919 | A | | 5/2000 | Reichert | |
| 6,073,352 | A | | 6/2000 | Zykan et al. | |
| 6,079,111 | A | | 6/2000 | Williams et al. | |
| 6,098,608 | A | * | 8/2000 | Oshlick | 33/265 |
| 6,119,672 | A | | 9/2000 | Closson | |
| 2003/0177651 | A1 | * | 9/2003 | Stone | 33/265 |

* cited by examiner

*Primary Examiner*—Diego Gutierrez
*Assistant Examiner*—Yaritza Guadalupe
(74) *Attorney, Agent, or Firm*—Warner Norcross & Judd LLP

(57) ABSTRACT

A bow sight including a fixed rear sight element and forward sight element that is adjustable to compensate for targets at varying ranges while an archer is drawing and/or aiming the bow. By moving the lever, the archer adjusts the forward sight element to accurately align thy bow sight with a target at a specific range. A range scale pointer is coupled to the forward sight element and points to a selected range on a range scale. Preferably, the range scale, pointer and both sight elements are in the archer's sight line so that the archer can confirm alignment of the bow sight with the target at a specific range as the archer is drawing and/or aiming the bow. The bow sight includes forward and rearward sight guards dimensioned that appear the same size to the archer while aiming to provide initial alignment of the bow sight with a target.

20 Claims, 5 Drawing Sheets

ARCHERY SIGHT

This application claims benefit of U.S. Provisional Application No. 60/351,059, filed Jan. 23, 2002 and entitled "Archery Sight."

BACKGROUND OF THE INVENTION

The present invention relates to archery, and more particularly to a target sight for a bow.

In the field of archery, bows are commonly outfitted with a target sight that aligns the flight of an arrow shot from the bow with a target. Conventional bow sights typically include one or more sight pins that must be aligned with a target for accurate shooting. To make this alignment, an archer draws bow string of the bow and positions the string at a specific location on his or her cheek, referred to as the "anchor point." Simultaneously, the archer aligns a single sight pin on the bow sight with a target along a sight line. When the sight pin is aligned with the target, the archer releases the arrow, and if the bow sight is properly sighted in, the arrow strikes the target.

Often, an archer desires to shoot targets located at different ranges, i.e., distances from the archer. Accordingly, many bow sights usually include multiple sight pins, aligned vertically one over the other. Each sight pin is calibrated for a target at a different range. Depending on the distance from the target, the archer selects one of the sight pins and aligns the sight pin with the target in their sight line when the bow is drawn. Assuming the distance judged by the archer is correct and the proper sight pin is selected, when the archer shoots the arrow it will hit the target.

Although a conventional bow sight offers archers a convenient way to shoot accurately, it suffers a number of shortcomings. First, the correct alignment of the pin and the target depends on the consistency of the archer's anchor point. For example, if the archer sights in the bow sight using a first anchor point, located on their cheek, and then subsequently aims the bow sight at a target using a second anchor point on their chin, then the sight pin will align with the target along a different sight line than that used to sight the bow. This will result in the sight pin not aligning with arrow's trajectory, thus causing a released arrow to miss the target. Second, although multiple sight pins on conventional bow sights enable an archer to accurately shoot at varying ranges, these frequently are clustered so closely that they obscure the target or appear to be a single, large pin, especially in low light.

One solution to some of the problems of conventional bow sights is offered by the bow sight illustrated in U.S. Pat. No. 5,718,215 to Kenny et al. The Kenny sight includes a forward sight pin that is vertically adjustable to align the rearward v-notch sight element with a target. The forward sight pin is coupled to a crank via a rack and pinion gear. To adjust the Kenny sight for targets at different ranges, an archer must position the bow across his lap and use one hand to turn the crank—thereby adjusting the forward sight pin—until a pointer on the crank registers with the desired range on a range scale.

Although Kenny offers a solution to the problems associated with conventional bow sights, it also suffers several problems. First, the crank of Kenny must be adjusted with one free hand. Therefore, the sight is unadjustable for range while the archer is drawing and/or aiming the bow. In hunting applications, this unadjustability is extremely problematic, especially when game moves from one range to another while the archer is aiming the bow sight. Moreover, the range scale and crank of the sight are completely out of view of the archer while the archer is drawing and/or aiming the bow, which gives them no ability to confirm that the range selected is appropriate after the bow is drawn. Furthermore, the gears of such a sight frequently become obstructed by debris if an archer carries the bow and sight through brush, or frozen in an immovable state when moisture on the gears freezes.

SUMMARY OF THE INVENTION

The aforementioned problems of the prior art are overcome in the present invention that provides a bow sight including a fixed rearward sight element and a forward sight element that adjusts to align the bow sight with a target at a specific range while the archer is aiming the bow sight at a target and/or drawing the bow.

In one embodiment, the bow sight includes a range scale pointer and a range scale, both of which are simultaneously in the archer's sight line while the archer is drawing and/or aiming the bow.

In another embodiment, the bow includes a trigger lever that is actuateable by a finger or thumb of the archer while drawing and/or aiming the bow.

In yet another embodiment, the bow sight includes a mounting bracket to which the forward sight element and pointer are slidably mounted and configured to move in unison when actuated by the trigger lever.

In still another embodiment, the bow sight includes forward and rearward sight guards that protect the forward and rearward sight elements. The rearward guard is smaller than the front guard so that the two guards align and appear as one in the archer's sight line.

The bow sight of the present invention offers many benefits over prior art bow sights. First, the bow sight of the present invention is adjustable to align an arrow's trajectory with targets at varying ranges while the archer is drawing and/or aiming the bow. Accordingly, the archer need not put the bow down to re-adjust the forward sight pin when game or a target moves from one range to another. Second, with the sight elements, range pointer and range scales simultaneously in the archer's sight line, the archer can confirm range selection or properly adjust range selection while the archer is drawing and/or aiming the bow. Third, with the simple lever arm adjustment mechanism, the bow sight is unlikely to become inoperable due to debris or frozen moisture. Further, the sight guards of the present invention enable an archer to quickly align the bow sight in a spontaneous shooting situation.

These and other objects, advantages and features of the invention will be more readily understood and appreciated by reference to the detailed description of the invention and the drawings.

DETAILED DESCRIPTION OF THE INVENTION

I. Overview

Figure 1:
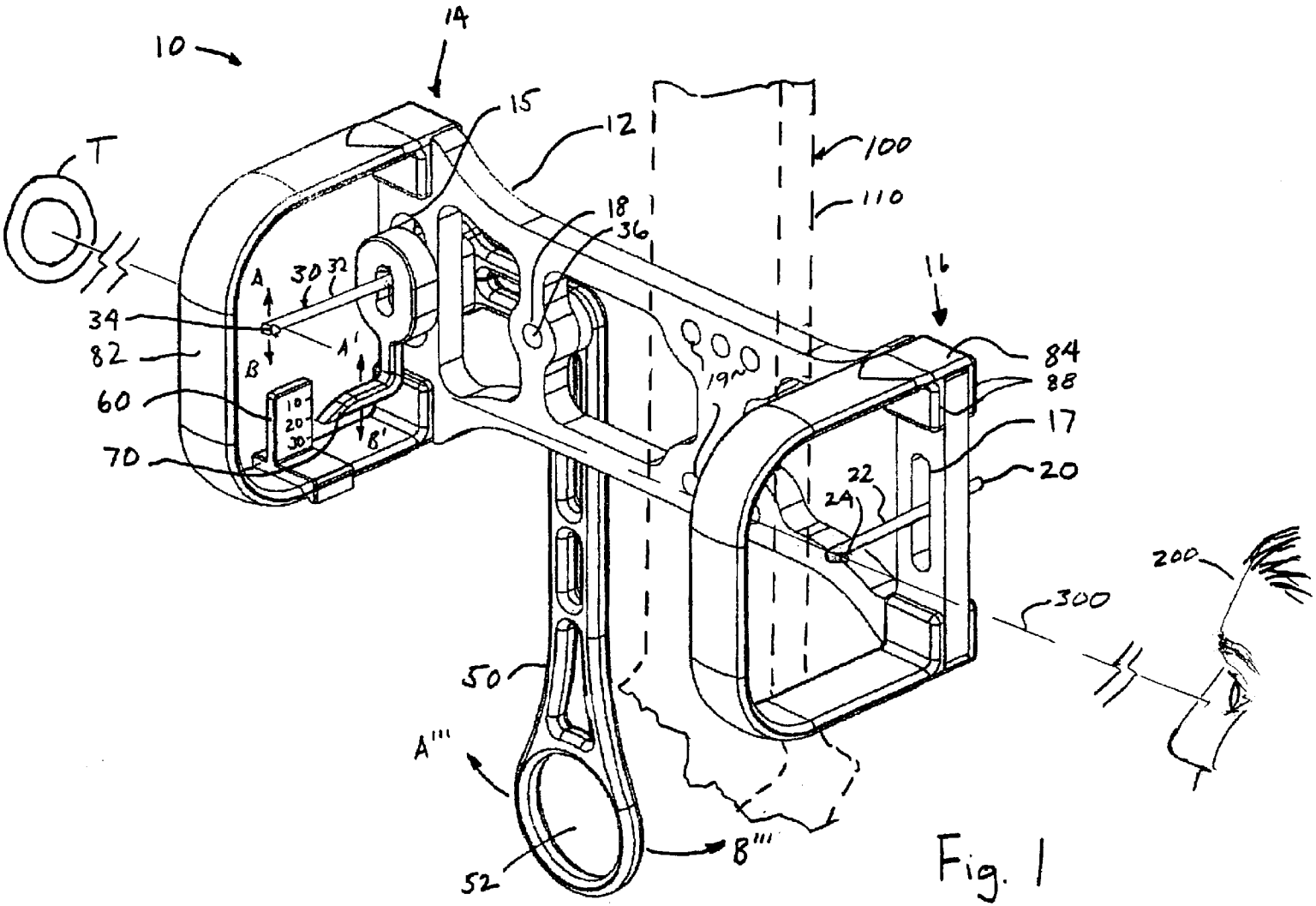
FIG. 1 is a rear perspective view of the archery sight of the present invention.
Figure 2:
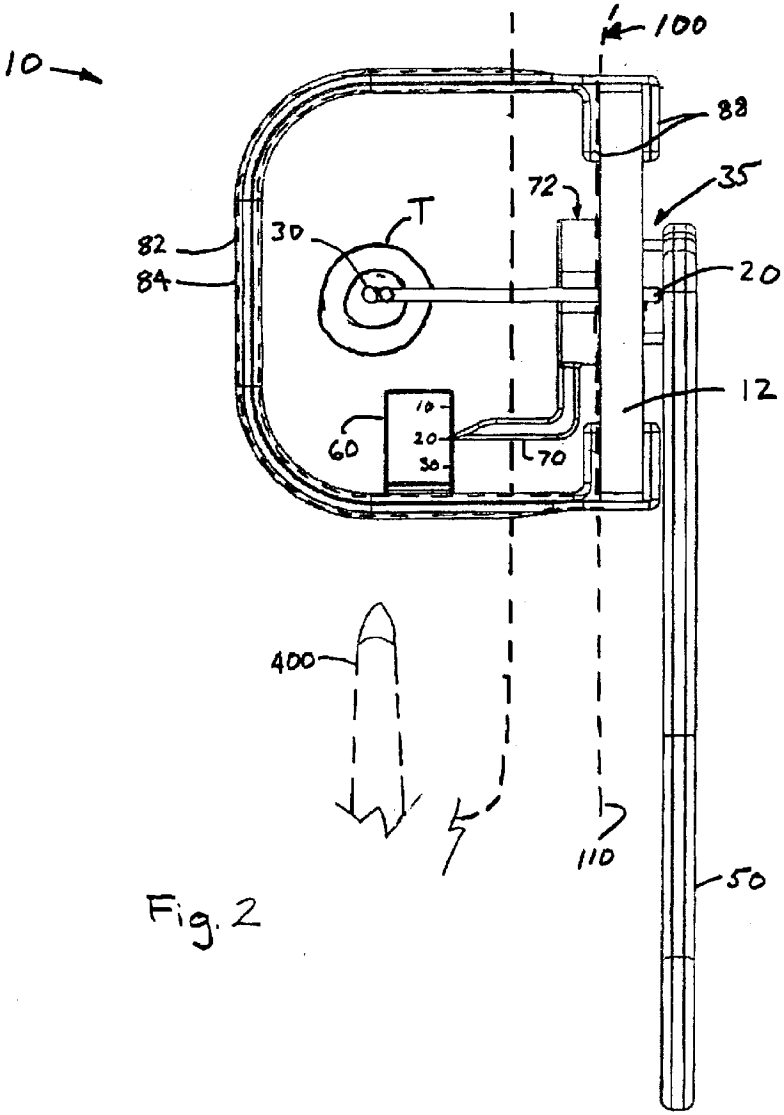
FIG. 2 is a rear elevational view of the archery sight along a sight line of an archer aiming the bow sight.
Figure 5:
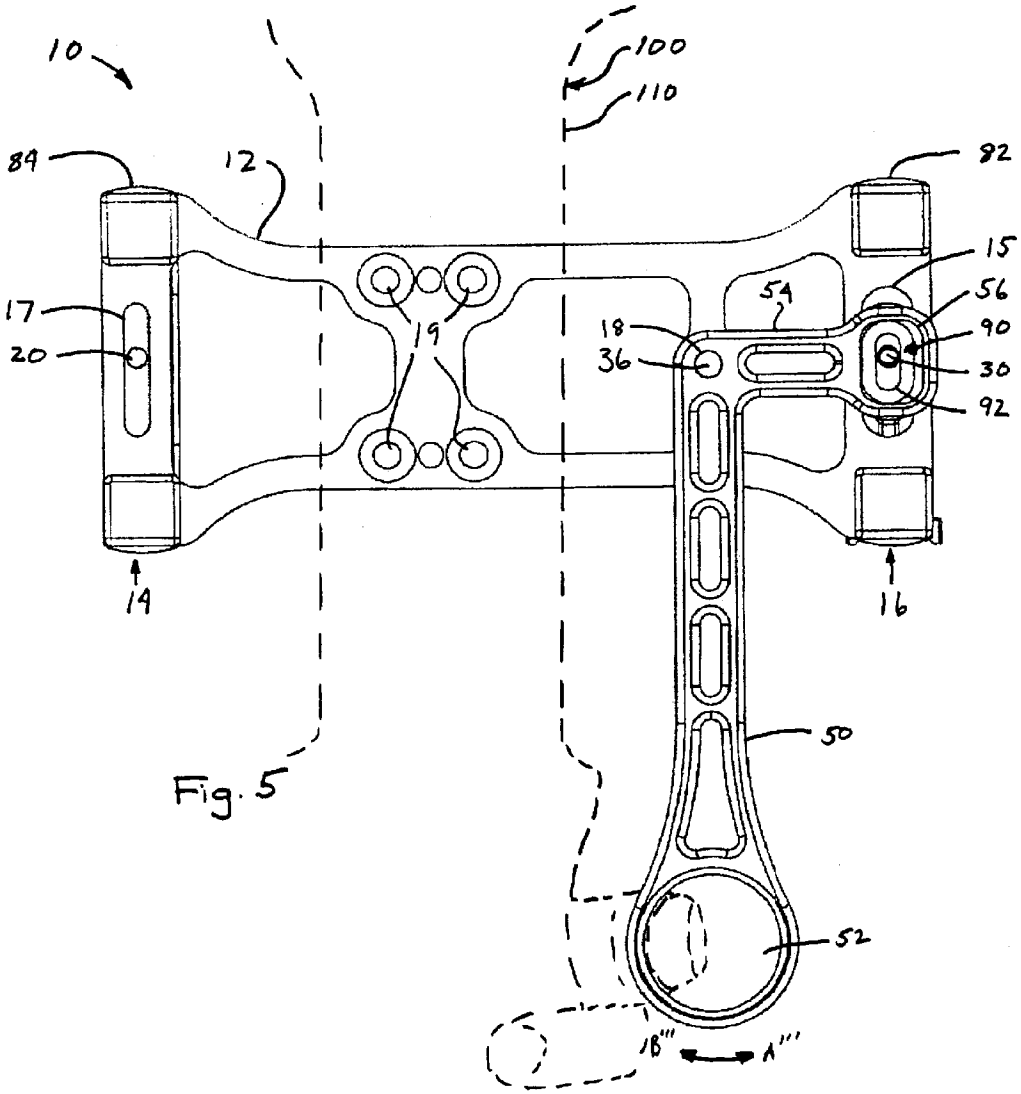
FIG. 5 is a side elevational view of the archery sight being adjusted by an archer.

A bow sight constructed in accordance with an embodiment of the invention is illustrated in the drawings and generally designated 10. As shown in FIGS. 1, 2 and 5, the sight 10 is adapted to be secured with conventional fasteners to an archery bow 100, preferably to the bow riser 110. The sight 10 of the present invention is suitable for any type of bow, including compound, recurve and long bows. The components of the sight 10 are a mounting bracket 12, a fixed rearward sight pin 20, a movable/adjustable forward sight pin 30, a range scale 60, a range scale pointer 70 and an adjustment lever 50, also referred to as a crank or a trigger. The lever 50 is pivotally connected to the bracket 12 and adjusts the sight pin 30 in directions A and B when lever 50 is moved in curvilinear paths A''' and B''', respectively. Optionally, the pointer 70 is fixedly secured to move in unison with the sight pin 30 in directions A' and B' when the lever is adjusted along paths A''' and B''', respectively, and thereby point to respective ranges on the range scale 60. Preferably, the forward sight pin 30, the rearward sight pin 20, the pointer 70 and the range scale 60 are all in the sight line of an archer when drawing and/or aiming the bow at a target T, as shown in FIGS. 1 and 2.

In use, an archer 200 draws and aims the archery sight 10, at a target T along sight line 300. While the bow is drawn, the archer estimates the range, that is, the distance to the target, and selects a range indicia on the range scale 60 corresponding to the estimated range of the target and accordingly the bow 100 in general, by moving the lever 50 in either of paths A''' or B''' depending on the initial position of the pointer 70 in relation to the index on the range scale 60. As the lever 50 is adjusted, the sight pin 30 also moves in directions A or B with the pointer 70 until the pointer registers with the desired range index. Accordingly, the archer may adjust the sight pin 30 as the archer is drawing and/or aiming the bow. As used herein, "drawing" the bow also may include the state of the bow at full draw. The archer 200 then aligns the rearward sight pin 20 with the forward sight pin 30 over the target as shown in FIG. 2. The archer then releases the arrow 400, and assuming the bow sight 10 is properly calibrated, the arrow hits the target.

II. Bow Sight Construction

With reference to the figures, the construction of the bow sight 10 will now be described in detail. The bow sight 10 includes a mounting plate 12 including forward end 14 and rearward end 16. As used herein, the term "forward" is used to describe a component that is located forward of another component along an archer's line of sight. The term "rearward" is used to describe a component that is located rearward of another component along an archer's sight line.

The mounting plate 12 includes a center portion defining multiple spaced apart apertures 19, which are optionally countersunk, that receive fasteners (not shown) to secure the mounting bracket 12 to the riser 110 of the bow 100. As shown, the mounting bracket 12 is mounted on the outside of the riser 110. In some applications, however, the mounting bracket may be moved to the other side of the riser, that is, the inside of the riser, over the arrow rest of the bow 100.

Figure 3:
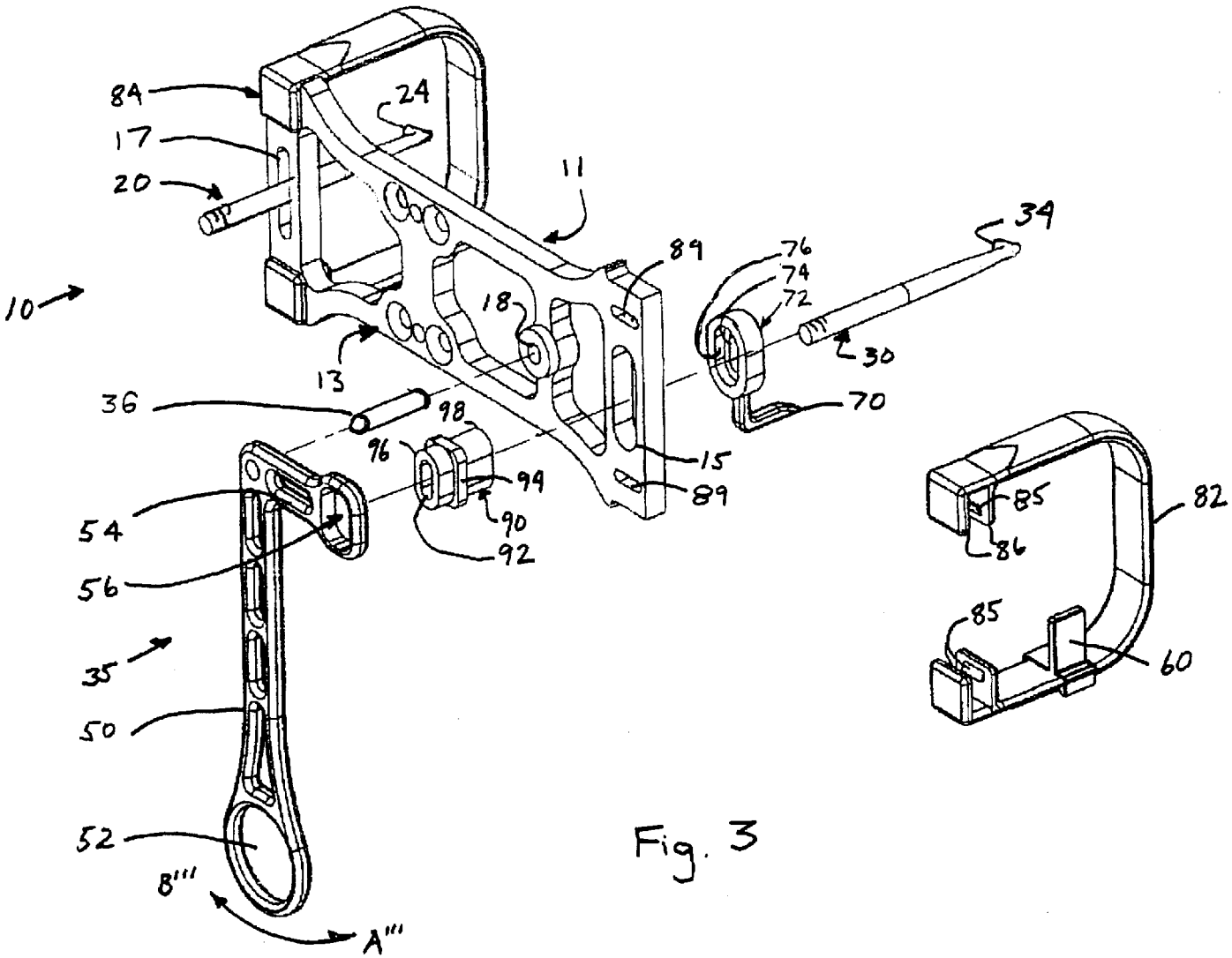
FIG. 3 is an exploded view of the archery sight.

As shown in FIGS. 1 and 3, the mounting bracket 14 defines a vertical forward slot 15 in the forward end 14 and another vertical rearward slot 17 in the rearward end 16. These vertical slots generally are oblong and include rounded ends. The mounting bracket further defines a pivot bore 18, in which a pivot pin 36 is rotatably disposed to pivotally connect the adjustment lever 50 to the bracket 12.

Optionally, the mounting plate is constructed so that the inside 11 and outside 14 of the mounting plate is identical, that is, the slots 15 and 17, pivot bore 18 and mounting holes 19 are located in the are relative locations regardless of whether the mounting bracket 12 is viewed from the inside 11 or outside 13. Thus, the bow sight 10 of the present invention is adapted to have the various components mounted to function on either the inside 111 or outside 13 of the mounting bracket. For example, the bow sight 10 shown in FIG. 1 is mounted on a right-handed bow 100. With the unique construction of the mounting bracket, the lever 50 may be secured to the inside 11 of the bracket and the forward sight guard 82, rearward sight guard 84, sight pins 20 and 30 may be reversed to be disposed on the outside 13 of the mounting bracket. Accordingly, the same components may be used to manufacture the bow sight of the present invention to fit for either left-hand bows or right-hand bows. Additionally, the bow sight of the present invention may be changed from a right-handed bow sight to a left-handed bow sight (or vice versa) by rotating the mounting bracket 12 forward and 14 to rearward and 16 180°, removing the lever 50 from the pivot pin 36 and replacing it on the pin 36 so that the lever extends downward on the rotated mounting bracket 12, and removing and replacing the mount 72 and the range scale 60 so that they are both below the forward sight pin 30 on the rotated bracket 12. The rotated bracket as modified may then be secured to a left-handed bow.

As shown in FIGS. 1–3, the forward 14 and rearward 16 sight element guards are secured to the mounting bracket 12 to prevent the sight elements 20 and 30 from being damaged. The guards include mounting flanges 86 and 88 that fit over the ends 14 and 16 of the mounting bracket 12. Referring to FIG. 3, the mounting bracket 12 optionally defines tab recesses 89, and the flanges 86 and 88 may include tabs 85 that snap-fit into the recesses 89 to hold the guards in fixed registration with the mounting bracket 12. Optionally, other fastening constructions may be used to secure the guards to the mounting bracket as the application requires. For example, set screws (not shown) may secure the flanges 86, 85 to the mounting bracket.

FIG. 2 illustrates an optional initial alignment feature of the bow sight 10. Specifically, the guards 82 and 84 are dimensioned so that they appear to be of substantially the same size when an archer aims at a target T. As shown in broken lines, the front sight 82 is at least partially obscured from view by the rearward sight element 84. However, in some constructions, the forward sight element may be at least partially viewable by the archer. To achieve this desired appearance, the rearward sight guard 84 is sized smaller than the forward sight guard so that the two sight guards align as shown. With this feature, the archer is provided a starting point for accurately aligning the sight elements 24 and 34 with the target T.

With reference to FIGS. 1–5, a range scale 60 is secured to the forward sight guard 82. Optionally, the range scale 60 is a clip-on type that clips over the edges of the guard 82 as shown. The range scale 60 may be constructed of a resilient material to enable it to be clipped over the forward sight guard 82. The range scale alternatively may secure to the forward sight guard 82 or to the mounting bracket 12 with conventional fasteners. As shown, the range scale 60 is adjacent or along the archer's sight line 300 so that as the archer is aiming the sight at a target T, the range scale 60 is within their view. Accordingly, the archer may aim and draw the bow while simultaneously confirming the range for which the bow sight 10 is set, as described below.

Optionally, multiple range scales 60 may be calibrated by the archer to accurately shoot arrows of different weights or dimensions, or different arrow tips. Accordingly, in the field, the archer may secure an arrow—or arrow tip—specific range scale to the bow sight 10 to easily accommodate the specific arrows or arrow tips that they are shooting.

As shown in FIGS. 1–3, the sight pins 20 and 30 mount to the bow sight 10 at the rearward 16 and forward 14 ends, respectively. The sight pins both generally include pin portions 22 and 32 and sight elements 24 and 34, respectively. The sight elements 24 and 34 may be any conventional sight element as known in the art. For example, the sight elements may be coated with colored paint, light absorbing phosphorescent materials, such as "glow-in-thedark" phosphoric materials, "day glow" paint, or other materials for increased low light visibility. Optionally, the sighting elements may be conventional tritium elements. The pin portions 32 and 22 of the forward 30 and rearward 20 sight pins, respectively, optionally are threaded so that locking elements (not shown), such as locking nuts or clamps may be threaded onto the bar portion to hold the sight pins in fixed relation to another component of the bow sight 10. For example, although not shown, a first nut may be threaded onto the pin portion 22 on the inside 11 of the bracket, and a second nut may be threaded onto the pin portion 22 that extends on the outside 13 of the bracket to hold the sight pin 20 in fixed relation relative to the bracket. Other conventional horizontal and vertical adjusting mechanisms may be substituted for this complimentary locking nut mechanism as desired to provide horizontal and vertical adjustment of the sight pins of the present invention. Further optionally, a portion or all of the sight pin may be of a polygon shape, for example, a hexagonal shape, so that the sight pin fits non-rotatably within the respective slot.

In an alternative embodiment of the bow sight 10 (not shown), the rearward sight pin 20 may be absent along with the rearward slot 17 and the rearward sight guard 84. The mounting bracket 12 of this alternative embodiment may also be truncated so that it does not extend rearward of the riser 110.

In the embodiments shown in the figures, the rearward sight pin 20 is preferably configured to allow the sight pin to be adjusted horizontally to left or to the right (FIG. 2) with respect to the mounting bracket 12 or up and down within slot 17 to allow for horizontal and vertical adjustment, respectively, of the sight element 24 when sighting the bow sight 10 as described below.

After the bow sight 10 is sighted in as described below, the rearward sight pin 20 remains disposed in fixed relation to the mounting bracket and does not move until the archer loosens the locking mechanism (not shown) and readjusts the rearward sight pin as desired. Therefore, as used herein, "fixed" refers to a state of a sight pin wherein the pin is immovable relative to another component of the bow sight 10 while the archer is aiming and/or drawing the bow.

The adjustment mechanism 35 of the bow sight 10 will now be described with reference to FIGS. 3–4. As shown, the adjustment mechanism 35 includes the adjustment lever 50 pivotally secured to the mounting bracket 12 via pivot pin 36. The lever includes a trigger hole 52 which is disposed adjacent an archer's hand (FIG. 5) so that the archer may actuate the lever with a digit when aiming and/or drawing the bow 100.

The lever also is joined with an arm 54 extending toward the forward end 14 of the sight. Disposed near or at the end of the arm 54 is an arm aperture 56 of a relatively oblong shape. Optionally, it may be of another shape, for example, a circular, elliptical, rectangular or square shape. The arm aperture is preferably configured to receive a portion of the sight pin holder 90 therein. For example, as shown in FIG. 3, the outer end 96 of the sight pin holder 90 is at least partially received in the arm aperture 56. The inner end 98 of the sight pin holder 90, to the right of the collar 94, is disposed through and slidable in the forward slot 50. In one embodiment, the exterior of the sight pin holder 90 is configured to mate with and slide within the slot when urged by adjustment of the adjustment lever 50. Optionally, the sight pin holder 90 is of an oblong shape as shown and includes a holder slot 92 along the longitudinal axis of the sight pin holder 90. Within the holder slot 92, the sight pin 30 may be disposed. Further optionally, the sight pin holder 90 and/or sight pin 30 are constrained to move in a substantially linear vertical line the slot 15. Other lines of movement, however, may be chosen as well and the slot 15 configured accordingly. As desired, the sight pin 30 may be secured, in fixed relation horizontally and vertically, to the sight pin holder 90 using conventional fastening means, for example, those described above in connection with the rearward sight pin 20.

Figure 4:
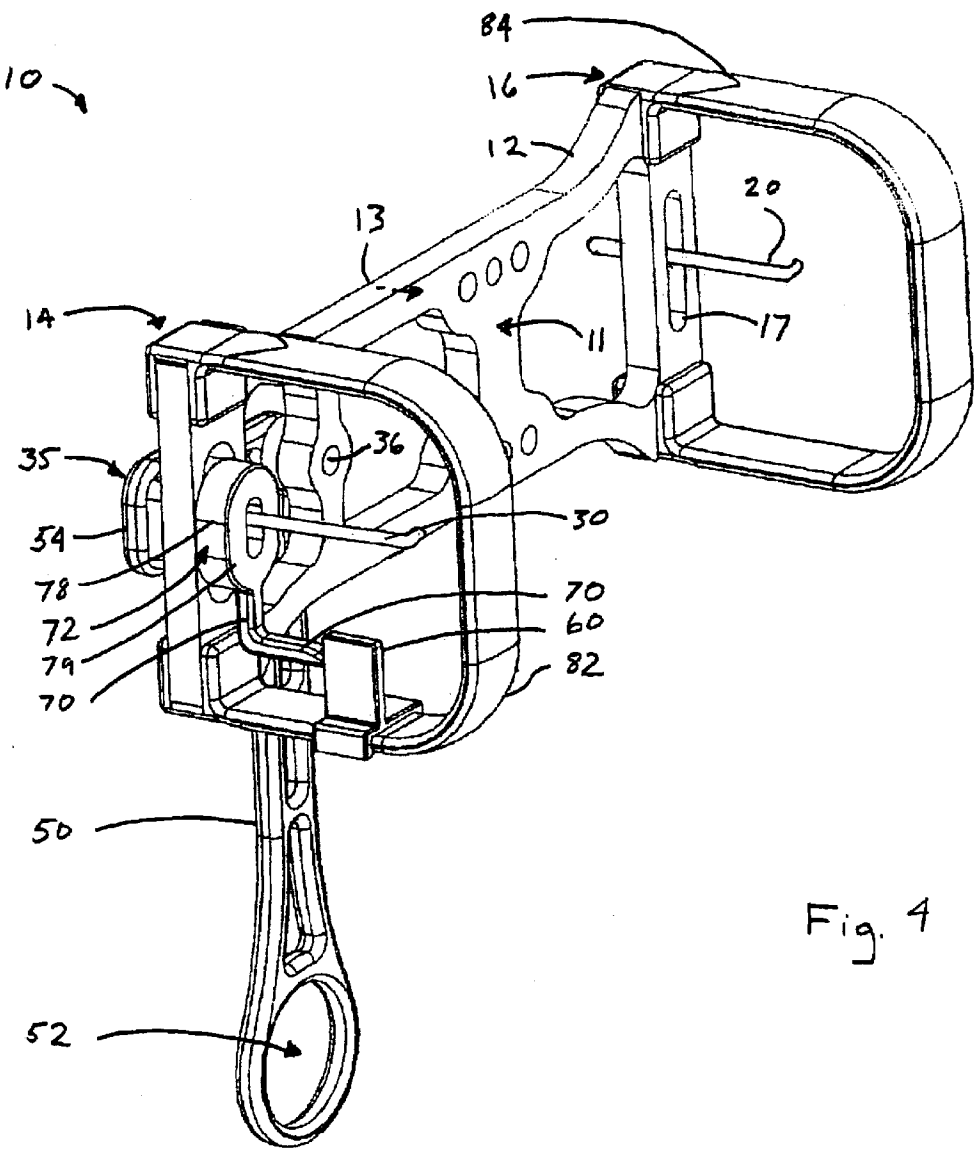
FIG. 4 is a front perspective view of the archery sight.

With further reference to FIGS. 3 and 4, the outer end 96 of the holder 90 fits within the aperture 56 but optionally leaves a gap between the perimeter of the outer end 96 and the aperture 56 to provide movement of the outer end of the holder 96 within the aperture 56 as the lever 50 is moved along paths A''' and B'''. The inner end 98 of the holder 90 extends through the mounting bracket 12 and protrudes from the inner side 11 thereof.

A pointer mount 72 to which the pointer 70 is connected is secured to the portion of the inner end 98 of the holder 90 disposed in and optionally protruding through the mounting plate 12. The pointer mount 72 defines a recess 76 within which the inner end 98 is disposed. The recess 76 as shown is of the same shape and configuration as the inner end, however, as desired, the shapes may be altered and the mount 72 secured to the inner end 98 by other means, for example, a set screw or glue or other fasteners. The mount 72 also includes a sight pin aperture 74 through which the sight pin 30 is disposed. Alternatively, the sight pin may be mounted directly to and extend from the pointer mount 72 in an adjustable fashion so that the sight pin aperture 74 and the holder slot 92 may be eliminated as desired. Furthermore, as shown in FIG. 4, the mount 72 may be of a multiple piece construction where including the range pointer mount collar 78 and a range scale mount plate 79 that is secured to the range scale pointer 70 by way of an inner flange (not shown), tab (not shown) or other component that interfits and secures the plate and pointer 70 to the inner collar 78. Additionally, referring to FIGS. 1, 2 and 4, the pointer 70 is preferably disposed adjacent the range scale 60, within the sight line 300 of the anchor to indicate to the archer the range at which the sight is configured to accurately shoot an arrow.

III. Bow Sight Operation

In operation, the bow sight 10 is mounted as described above to riser 110 of a bow 100. To "sight in" the bow sight 10, and thus, the bow 100 in general, the rearward sight pin 20 is first removed from the mounting bracket 12. The archer then adjusts the lever 50 with a digit as shown in FIG. 5 to an initial range. Preferably, this initial range moves the lever 50 in a direction so that the pointer 70 is disposed at the top of the uppermost portion of the range scale 60. Incidentally, when the bow sight 10 is initially calibrated, it includes no index on the range scale because the archer must demarcate these index based on the sighting in procedure described herein.

The uppermost portion of the range scale is used to sight in the bow at a close range, for example, 10 yards. This enables the archer to use the lowermost portions of the range scale 60 to demarcate index for greater ranges, for example, 20 and 30 yards. With the pointer 70 pointing at a region on the uppermost portion of the range scale 60, the archer then moves to a first range from his target T, preferably at the shortest range at which he desires to mark an indicia on the range scale, for example, 10 yards. The archer then marks the range scale at the point where the pointer 70 overlaps the range scale with an indicia, for example, "10" to indicate 10 yards. Standing at that 10 yard range from the target T, the archer then draws the bow string on the bow readying an arrow for propulsion. The archer positions the sight pin 30, specifically, the sight element 34, on the target T to aim the bow while it is drawn. The archer then releases the arrow. If the arrow hits the target, then the bow sight 10 is properly adjusted. If the arrow does not hit the target, the bow sight must be recalibrated for whatever offset was monitored. For example, if the arrow hit to the right of the target, the archer adjusts the sight pin 30 to slide it horizontally to the right relative to the sight pin holder 90. If the arrow hit to the left of the target, the archer adjusts the sight pin 30 to the left relative to the sight pin holder 90. As described above, when adjusting the forward sight pin 30, the pin portion 22 of the pin 30 moves inward and/or outward relative to the sight pin holder slot 92. If the arrow went high or low, the forward sight pin 30 is moved upward or downward in those vertical directions, respectively, relative to the sight pin holder 90. During this sighting in of the bow, the conventional fastener (not shown) associated with the sight pin 30 may be loosened and then retightened to secure the sight pin in a fixed position relative to the sight pin holder 90.

Adjustment to the forward sight pin are made until the arrow consistently hits the target at the first range, for example, 10 yards. Then, the front sight pin 30 is tightened down and secured in relation to the sight pin holder 90. By doing so, the sight pin 30, and therefore the sight element 34, are disposed in a fixed position relative to the range pointer 70.

With the bow sight 10 sighted in at a close range, e.g., 10 yards, the archer may install the rearward sight pin 20 in the rearward bracket slot 17 and tighten it in place. The rearward sight pin is positioned so that the rearward sight element 24 is disposed inwardly, i.e., closer to the bracket, than the forward sight pin element 34 as shown in FIG. 2. Notably, the bow sight shown in FIG. 2 has already been calibrated and the bow sight is adjusted for a 20 yard range rather than a 10 yard range. Furthermore, although shown as including a single pin element 24, the rearward sight pin 20 may include first and second sight pin elements (not shown) that align horizontally or vertically on opposite sides of the forward sight element 34 to indicate proper alignment. The rearward sight pin 20 may alternatively include a v-notch or other sight pin configuration that aligns with the forward sight pin element 34 as desired.

The archer selects another range, for example, 20 yards, for which they desire to calibrate the bow sight 10. The archer moves the target to the desired range, for example, 20 yards from the point at which she will shoot the bow. With reference to FIGS. 1 and 5, the archer inserts a digit into the lever trigger 52 and moves the lever 50 in the curvilinear path B'''. In so doing, the lever and arm pivot about the pivot pin 36. As a result, the internal portion of the arm aperture 56 engages the sight pin holder 90 sliding it downwardly within the forward sight pin slot 15. Accordingly, as a result, the sight pin 30 and sight pin element 34 move downwardly in direction B. Likewise, the pointer moves downwardly in unison with the sight pin 30 in direction B'. This adjustment can be made by the archer while the bow is drawn and while the archer is aiming the arrow at the target T.

The archer aligns the forward sight pin element 34 adjacent the rearward sight pin element 24 as shown in FIG. 2 along a sight line toward target T. Because the sight pin 30 was moved in direction B, the angle of the bow 100 is altered, and thus the trajectory of the arrow. The archer then shoots the arrow at the target T. If the arrow hits the target, the bow sight 10 is properly adjusted and the user may demarcate on the range scale 20 yards, for example, by marking "20" at a point adjacent the location where the pointer 70 overlaps the range scale 60. Incidentally, the archer likely need not horizontally adjust either to forward or rearward sight pins because after initial alignment at close range, the arrow will shoot consistently from left to right. The only variance will be in the vertical plane due to gravity and the drop of the arrow under the influence thereof. If the arrow flew over the target or under the target, the archer moves the lever 50 in directions A''' or B''', respectively an incremental amount. The archer then continues to make such adjustments to the lever 50 until the arrow consistently hits the target where desired when the archer is stand 20 yards. The archer then marks a 20 yard range on the range scale 60 as described above. The archer then repeats this sighting in process at varying ranges and marks on the range scale 60 the index with which the pointer 70 must be aligned to accurately shoot at those ranges.

After sighted in at the varying ranges, the bow sight 10 is calibrated. In the field, the archer shoots an arrow at a target as follows. The archer may quickly aim the bow sight 10 and draw the bow 100 to prepare an arrow for a shot. To initially align the bow sight with the target, the archer may ensure the forward and rearward sight guards 82 and 84 are aligned and appear as single sight guard. The archer then determines the range to the target and with a digit as shown in FIG. 5, moves the lever 50 to adjust the pointer 70 to the range at which the target is located. Even though the bow is drawn and the archer is looking at the target, the archer can confirm that the pointer points to the appropriate range because it is within their sight line. The archer then aligns the rearward sight pin element 24 and the forward sight pin element 34 adjacent one another as shown in FIGS. 1 and 2 and aligns both elements with the target along sight line 300. The archer may then shoot the arrow with confidence that it will hit the target.

The bow sight 10 and components thereof of the present invention may be constructed of a variety of materials, for example, metal, polymers or other synthetic materials. The bow sight 10 may also be finished as desired with special coatings, paints or cathodic layers to protect the components from the elements and premature aging.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. An adjustable sight for a bow comprising:

a mounting bracket including a forward end and a rearward end;

a rearward sight pin fixedly mounted to the rearward end;

an adjustment lever pivotally joined with the mounting bracket including an arm, the adjustment lever and arm movable relative to the mounting bracket and the bow in a curvilinear path by an archer while drawing the bow and aiming at a target;

a forward sight pin;

means for adjusting the forward sight pin in a first direction when the adjustment lever is moved relative to the mounting bracket and the bow in the curvilinear path by the archer while drawing the bow and aiming at a target;

a pointer fixedly joined in fixed relation to the forward sight pin, said pointer moving in unison with the forward sight pin in the first direction and moving relative to the mounting bracket and the bow when the adjustment lever is moved in the curvilinear path; and a range scale adjacent the pointer, wherein the pointer, forward sight pin and range scale are viewed by the archer while the bow is drawn and while aiming at a target.

2. The adjustable sight of claim 1 wherein the mounting bracket defines a mounting bracket slot in the forward end.

3. The adjustable sight of claim 2 wherein the adjusting means includes a sight pin holder slidably received in the mounting bracket slot, the sight pin holder defining a sight pin slot.

4. The adjustable sight of claim 3 wherein the forward sight pin is substantially vertically adjustable in sliding relation to the sight pin slot and wherein the sight pin holder is substantially vertically adjustable in sliding relation to the mounting bracket slot.

5. The adjustable sight of claim 4 wherein the arm defines an arm aperture, the sight pin holder at least partially disposed in the arm aperture.

6. The adjustable sight of claim 1 wherein the forward sight pin is disposed in slot means for constraining movement of the forward sight pin within a substantially vertical linear path.

7. The adjustable sight of claim 1 comprising a forward sign pin guard and a rearward sight pin guard.

8. The adjustable sight of claim 7 wherein the rearward sight pin guard is dimensioned so that it aligns with the forward sight pin while the archer aims the bow.

9. The adjustable sight of claim 8 wherein the rearward sight pin guard substantially obscures the forward sight pin guard along an archer's sight line whereby the archer can confirm an initial alignment of the rearward sight pin and the forward sight pin along the sight line.

10. A bow sight comprising:

a bracket adapted to mount to a bow;

a first sight pin mounted in fixed relation to the bracket;

a second sight pin coupled to the bracket and selectively movable in a first direction relative to the bracket and the bow by an archer aiming the bow toward a target, the second sight pin forward of the first sight pin in relation to the archer aiming the bow toward the target;

a range scale that displays a range to the archer while aiming the bow toward the target; and a pointer adjacent the range scale that points to the range, wherein the pointer is coupled to the second sight pin and moves with the second sight pin in the first direction.

11. The bow sight of claim 10 comprising a trigger for moving the second sight pin in the first direction, the trigger actuated by the archer while aiming the bow toward a target.

12. The bow sight of claim 10 comprising a sight pin holder slidably mounted to the bracket.

13. The bow sight of claim 10 comprising a lever pivotally connected to the bracket and operatively connected to the second sight pin, the lever actuated by the archer while drawing the bow and aiming the bow toward a target.

14. The bow sight of claim 10 the first sign pin is immoveable in any direction relative to the bracket by the archer aiming the bow toward the target.

15. The bow sight of claim 11 wherein the pointer is adjustable in relation to the range scale so that the archer visually confirms the pointer points to the range on the range scale while aiming the bow at a target.

16. A sight for a bow used by an archer comprising:

a fixed sight element;

a movable sight element disposed forward of the fixed sight element in relation to the archer;

a range scale pointer coupled to the movable sight element;

a range scale disposed near the range scale pointer; and an adjuster coupled to the movable sight element and the range scale pointer, the adjuster moving the moveable sight and the range scale pointer in the same direction, wherein the adjuster moves relative to the bow, wherein the adjuster is actuated by the archer while the bow is drawn so that the moveable sight element moves relative to the bow.

17. The sight of claim 16 wherein the fixed sight element, the moveable sight element, the range scale pointer and the range scale are simultaneously displayed in a sight line of the archer while the bow is drawn.

18. The sight of claim 16 wherein the movable sight pin and the range scale pointer are fixedly mounted relative to one another.

19. The sight of claim 16 comprising a first sight guard mounted adjacent the fixed sight element and a second sight guard mounted adjacent the movable sight element, the second sight guard dimension larger than the first, whereby the first and second sight element guards are of a same size in a sight line of the archer.

20. The sight of claim 16 wherein the movable sight pin and the range pointer are positioned a fixed distance away from one another and both move in the same direction when the adjustment means is actuated.

* * * * *